US006237317B1

(12) United States Patent
Stahlecker

(10) Patent No.: US 6,237,317 B1
(45) Date of Patent: May 29, 2001

(54) CONDENSING ZONE FOR A SPINNING MACHINE

(75) Inventor: Hans Stahlecker, Haldenstrasse 20, 73079 Suessen (DE)

(73) Assignees: Fritz Stachlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/360,991

(22) Filed: Jul. 27, 1999

(30) Foreign Application Priority Data

Aug. 17, 1998 (DE) ..... 198 37 178

(51) Int. Cl.[7] ..... D01H 5/28

(52) U.S. Cl. ..... 57/315; 57/328; 19/150; 19/246

(58) Field of Search ..... 57/264, 304, 315, 57/328, 333; 19/150, 236–250, 252, 286, 287, 288, 304–308, 263

(56) References Cited

U.S. PATENT DOCUMENTS 4,953,349 * 9/1990 Fehrer ..... 57/315
5,431,005 * 7/1995 Fehrer ..... 57/315
5,600,872 2/1997 Artzt et al. .

* cited by examiner

*Primary Examiner*—John J. Calvert
*Assistant Examiner*—Gary L. Welch
(74) *Attorney, Agent, or Firm*—Evenson, McKeown, Edwards & Lenahan, P.L.L.C.

(57) ABSTRACT

A condensing zone is arranged downstream of the main drafting area of a drafting assembly of a ring spinning machine, which condensing zone is defined on one side by a front roller pair of the drafting assembly and on the other side by a nipping roller which presses a drafted fiber strand against a supporting surface. The peripheral speed of the nipping roller is from 3% to 8% greater than the peripheral speed of the front roller pair. The fiber strand to be condensed obtains thus a lasting draft in the condensing zone.

28 Claims, 5 Drawing Sheets

CONDENSING ZONE FOR A SPINNING MACHINE

BACKGROUND AND SUMMARY OF THE INVENTION

This application claims the priority of German application 198 37 178.0, filed in Germany on Aug. 17, 1998, the disclosure of which is expressly incorporated by reference herein.

The present invention relates to an arrangement in a ring spinning machine comprising a front roller pair which ends the main drafting zone of a drafting assembly and also comprising a condensing zone downstream thereof, which condensing zone bundles a drafted fiber strand and which condensing zone is ended by a driven nipping roller which presses the fiber strand against a supporting surface, the peripheral speed of said nipping roller being adapted to the peripheral speed of the front roller pair.

An arrangement of this type is described in U.S. Pat. No. 5,600,872, in which the peripheral speed of the nipping roller and the front roller pair are calculated in such a way that the necessary fiber strand tension for a fault-free transport is ensured. Excessive tension is disclosed there as being undesirable as this would impair the bundling of the fibers.

It has been shown that in the case of such a measure, the optimal tear strength of the spun yarn is not yet attainable. It is therefore an object of the present invention to measure the tension draft so that the tear strength of the yarn is increased.

This object has been achieved in accordance with the present invention in that the peripheral speed of the nipping roller is 3% to 8% greater than the peripheral speed of the front roller pair.

Such a ratio of the peripheral speeds serves not only to provide the necessary tension to ensure a fault-free transport of the fiber strand, but also leads furthermore to a lasting, if slight, draft. The condensing zone thus becomes intentionally subject to draft according to the present invention. The yarn tear strength is hereby significantly increased. The view of experts in the textile industry that a fiber strand could only be condensed in an almost completely draft free zone could not be confirmed.

With regard to the drive, the nipping roller is advantageously connected to a roller of the front roller pair. This has the advantage that, in the case of a change in the drafting drive, the drive of the nipping roller is automatically altered by the correct amount.

In an embodiment of the present invention a sieve belt is arranged at the nipping roller, which sieve belt transports the fiber strand with the peripheral speed of the nipping roller over a suction slit. The suction slit is located for this purpose in a stationary sliding surface. The sieve belt has two functions, the first being namely to guide the fiber strand through the subsequent drafting zone and the second being to homogenize an air stream for pneumatic condensing. The sieve belt can be driven by a nipping roller, or in reverse, the sieve belt can drive the nipping roller.

It is advantageous when the sieve belt is smoother on its side facing the sliding surface than on the side facing away from the sliding surface. This takes into consideration the fact that the sieve belt on the one hand slides on a stationary sliding surface, and on the other hand is a component part of a friction drive. In order that the fiber strand is disposed closely fitting on the sliding surface, said sliding surface is curved in transport direction for this purpose.

For ease of operation, it is practical when the nipping roller is integrated into the top weighting arm already present in the relevant drafting assembly.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
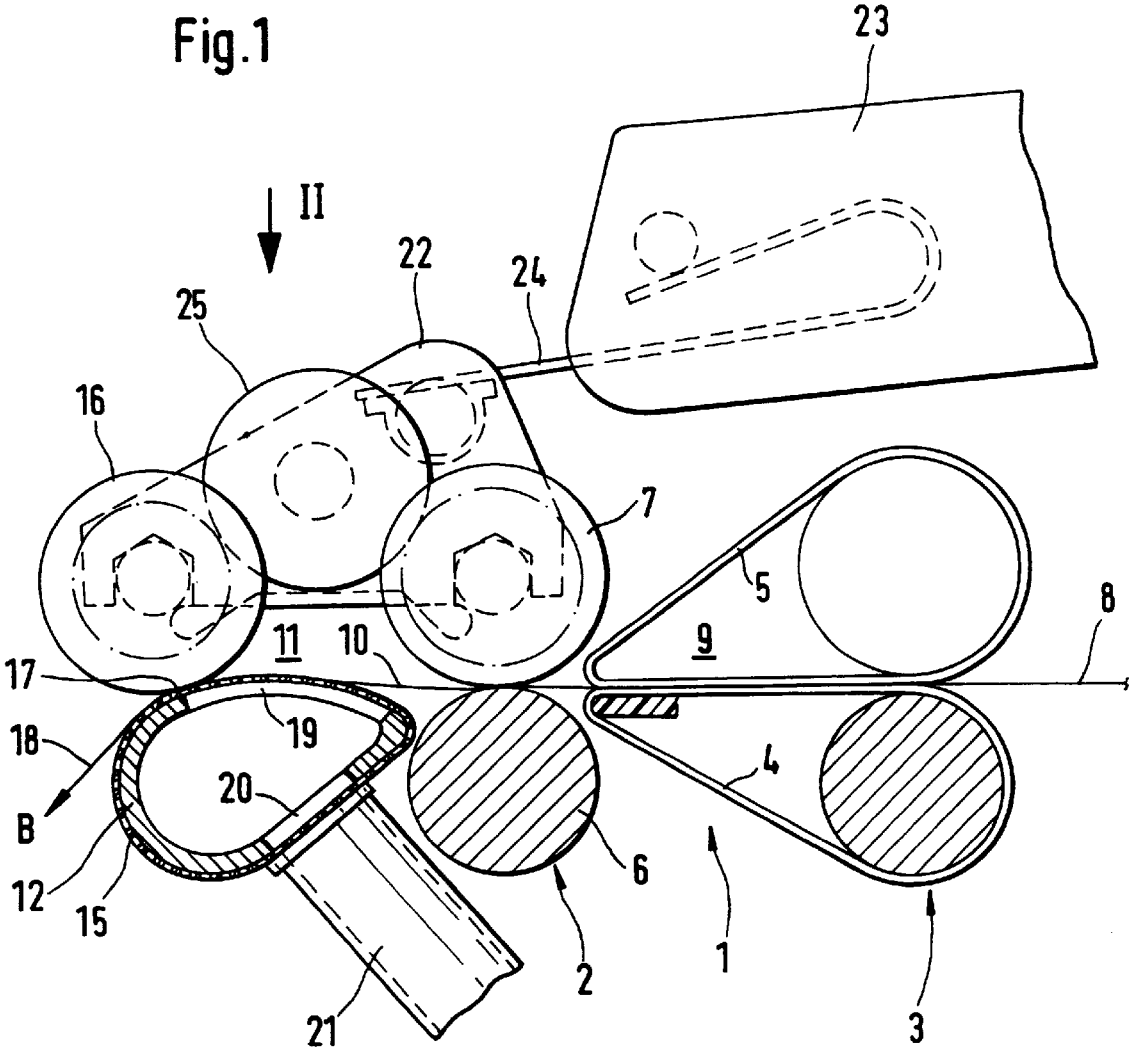
FIG. 1 is a partly sectional side schematic view of an arrangement according to the present invention in the area of the condensing zone.
Figure 2:
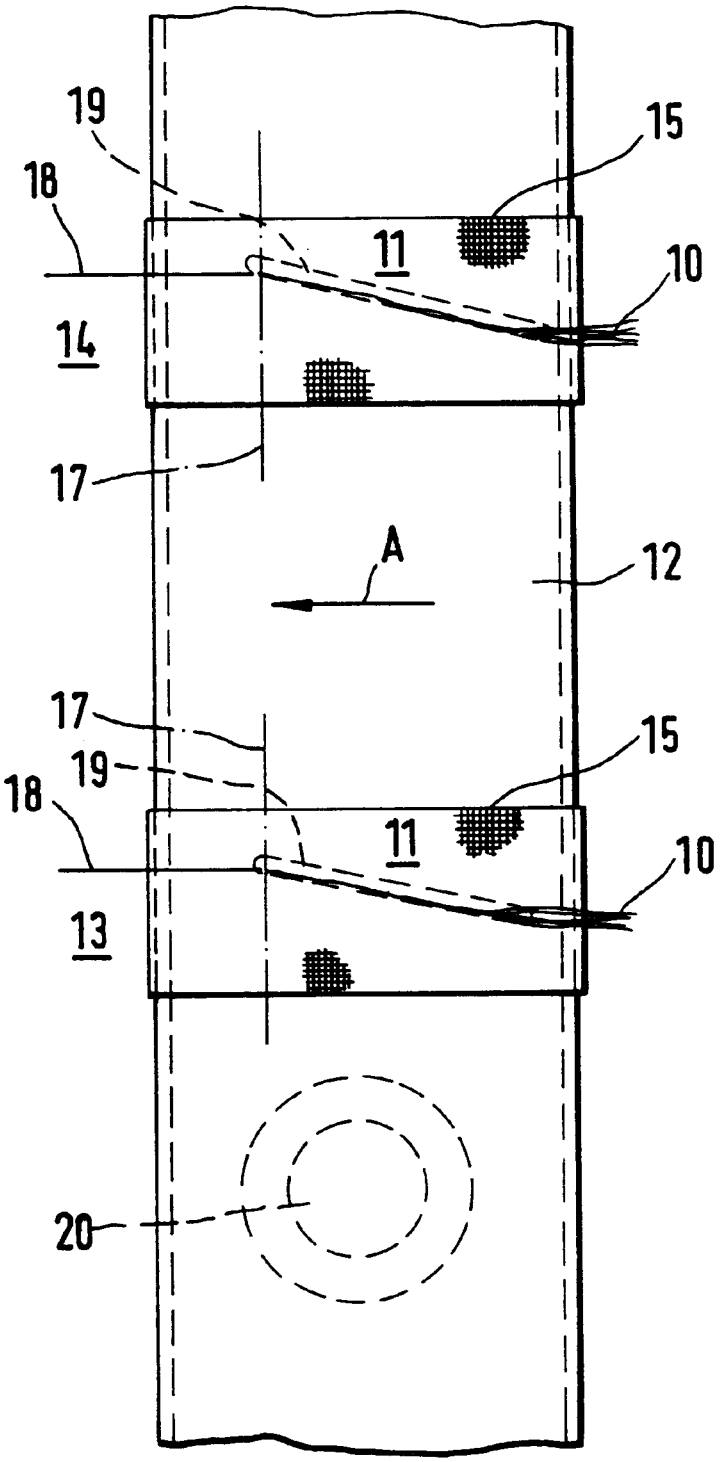
FIG. 2 is a part view in the direction of the arrow II of FIG. 1 onto a hollow profile, over which two sieve belts of two adjacent spinning stations slide.

The arrangement in a ring spinning machine according to the present invention shown in FIGS. 1 and 2 is placed downstream of a drafting assembly 1 which is only partly shown. Of the drafting assembly 1, only the front roller pair 2 as well as the apron roller pair 3 arranged upstream thereof are essentially shown. A lower apron 4 and an upper apron 5 are driven in a known way by the apron roller pair 2. The front roller pair 2 comprises per spinning station a front lower roller 6, which is a component part of a bottom roller shifting extending in a machine longitudinal direction, as well as a front top roller 7.

In the drafting assembly 1, a sliver or roving 8 is drafted to the desired yarn fineness. The main drafting area 9 of the drafting assembly 1 is located between the apron roller pair 3 and the front roller pair 2. Downstream of the front roller pair 2 an almost completely drafted fiber strand 10 exists, which is however imparted a slight subsequent draft, namely in a condensing zone 11 arranged downstream of the drafting assembly 1. In this condensing zone 11, the fiber strand 10 is condensed under slight draft by means of a bundling process, whereby outwardly projecting edge fibers are rolled around the core strand, which results in the fiber strand 10 becoming less hairy and at the same time more tear resistant.

The condensing arrangement comprises a hollow profile 12, which is a component part of a suction device and which extends over a plurality of spinning stations 13, 14. The stationary arranged hollow profile 12 comprises a sliding surface on its outer contour for a circulating sieve belt 15, whose length is so defined that it loops around the hollow profile 12 under a light tension. The sieve belt 15 is a thin, woven fabric with which the fiber strand 10 to be condensed is transported in transport direction A through the condensing zone 11.

A driven nipping roller 16, which in turn drives the sieve belt 15, forms the end of the condensing zone 11. The nipping roller 16 forms together with the hollow profile 12 a nipping line 17. Thereafter the yarn 18 is fed in delivery direction B to a ring spindle (not shown), where a twist is imparted. The twist goes back only to the nipping line 17, which thus functions as a twist block. The condensing zone 11 is thus free of all spinning twist.

The hollow profile 12 has per spinning station 13,14 . . . Ea suction slit 19, which extends essentially in transport direction A, is however arranged slightly diagonally thereto and is somewhat wider than the fiber strand 10. The hollow profile 12 has, on its side facing away from the suction slits 19, per machine section a suction opening 20, which is connected to a vacuum source by means of a conduit 21.

In order that the sieve belt 15 is, on the one hand, driven by the nipping roller 16, and can, on the other hand, however, slide smoothly on the sliding surface of the hollow profile 12, the two sides of the sieve belt 15 vary in smoothness.

The nipping roller 16 is arranged together with the front top roller 7 in a rocker 22, which is supported in turn by the top weighting arm 23 of the drafting assembly 1. The front top roller 7 and the nipping roller 16 are both loaded by means of a joint loading spring 24, whereby the arrangement is such that the pressure of the front top roller 7 on the front bottom roller 6 is greater than the loading pressure of the nipping roller 16 on the hollow profile 12.

The drive of the nipping roller 16 is derived from the front top roller 7, namely by means of a transfer roller 25, which is in the form of a friction wheel or a toothed wheel. It is possible, by means of a relevant choice of diameter, to produce the desired draft during the bundling process in the condensing zone 11, whereby the draft is between 3% and 8%. It has been shown that a draft of approximately 6% in the condensing zone 11 results in good tear resistant values for the yarn 18. What is involved here is not the usual tension draft between two drive rollers, but rather a lasting draft, which reaches the yarn 18. The transfer roller 25 relays the necessary nipping roller 16 peripheral speed.

In the following embodiments a repeat description is omitted, insofar as the same components are involved, reference is made to the description of FIGS. 1 and 2

Figure 3:
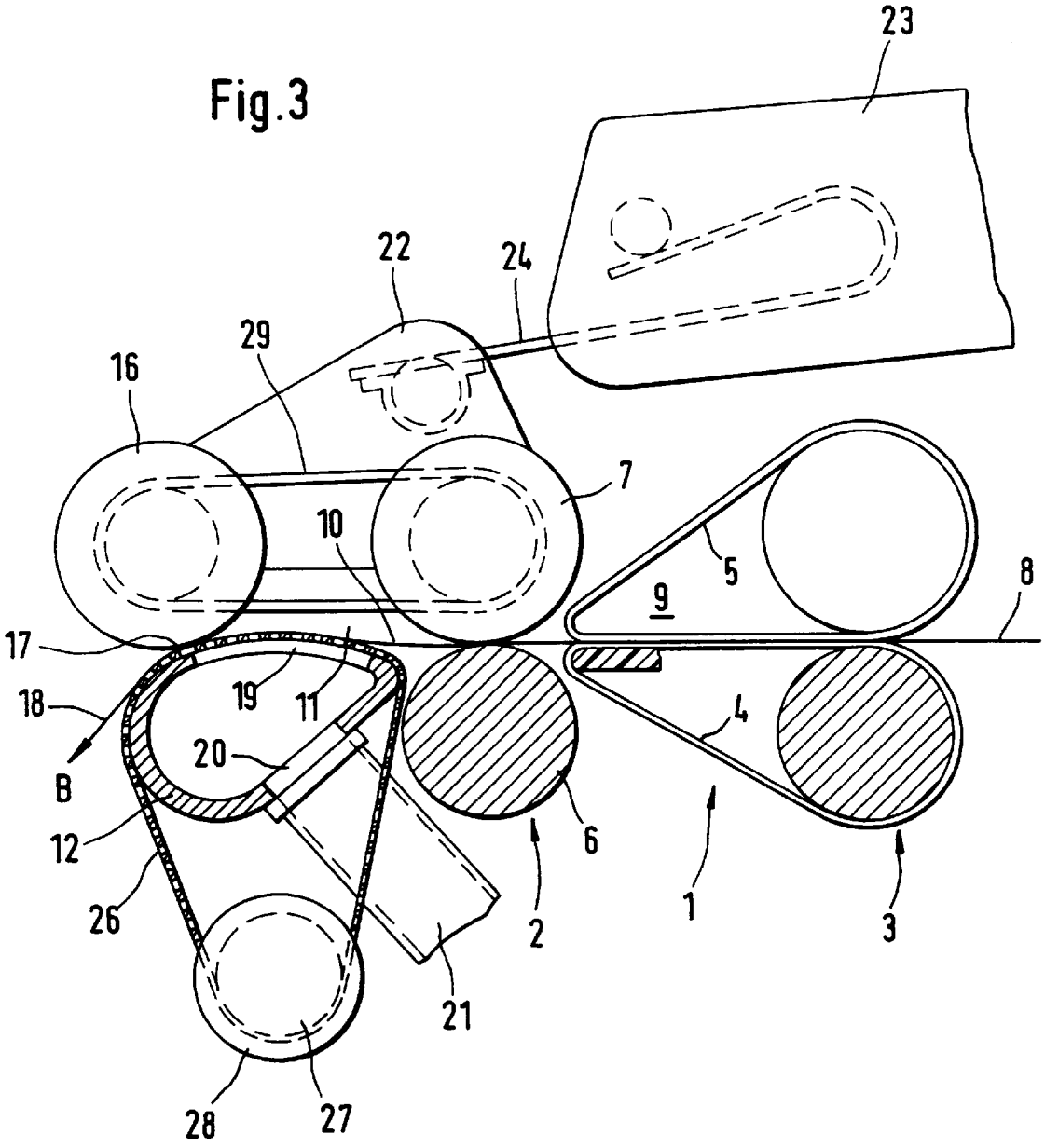
FIG. 3 is a view similar to FIG. 1 showing another nipping roller drive.

The embodiment according to FIG. 3 differs from the embodiment described above essentially in the different type of drive of the nipping roller 16 as well as in the different form of the sieve belt 26, which is longer than in the embodiment in FIGS. 1 and 2.

A tension pulley 27 is arranged to the sieve belt 26 in the variation shown in FIG. 3, which tension pulley 27 comprises two lateral rims 28 for lateral guidance of the sieve belt 26.

The nipping roller 16 is driven by means of a transfer belt 29 by the front top roller 7. In the case of the transfer belt 29, a flat, round or toothed belt can be involved. This embodiment and the choice of suitable diameters also permit the desired peripheral speeds between the front roller pair 2 and the nipping roller 16, so that a slight, but lasting draft occurs in the fiber strand 10.

Figure 4:
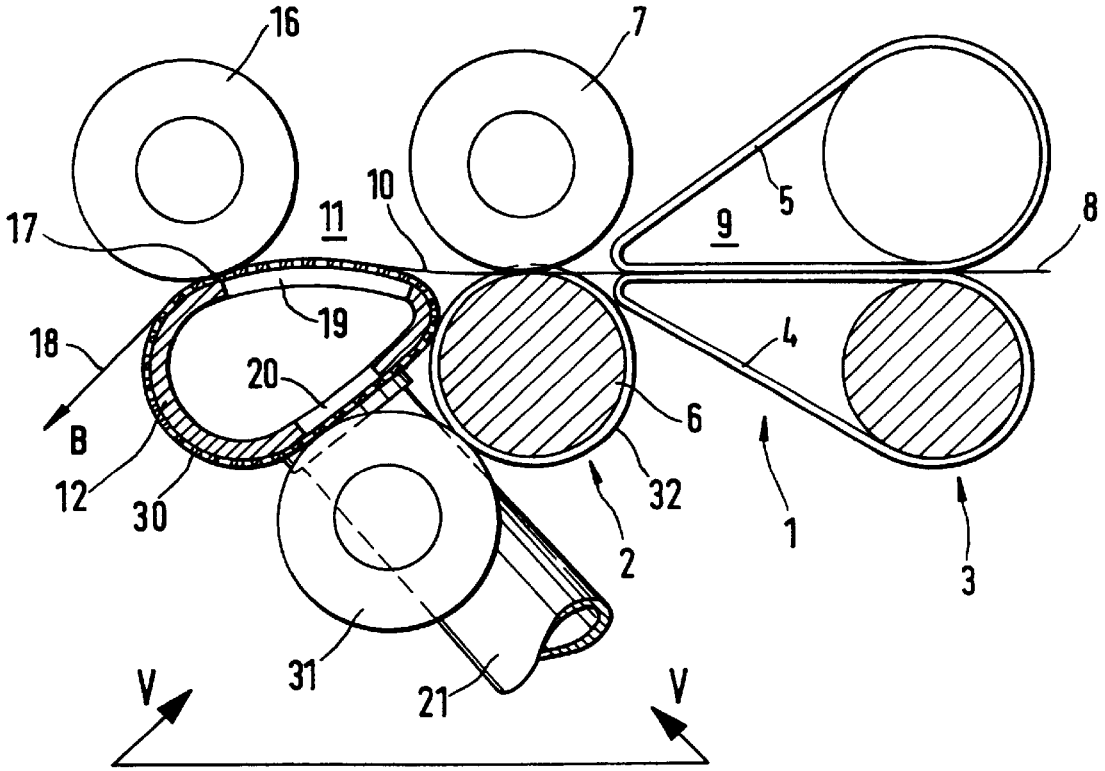
FIG. 4 is a view similar to FIGS. 1 and 3 showing another sieve belt drive.
Figure 5:
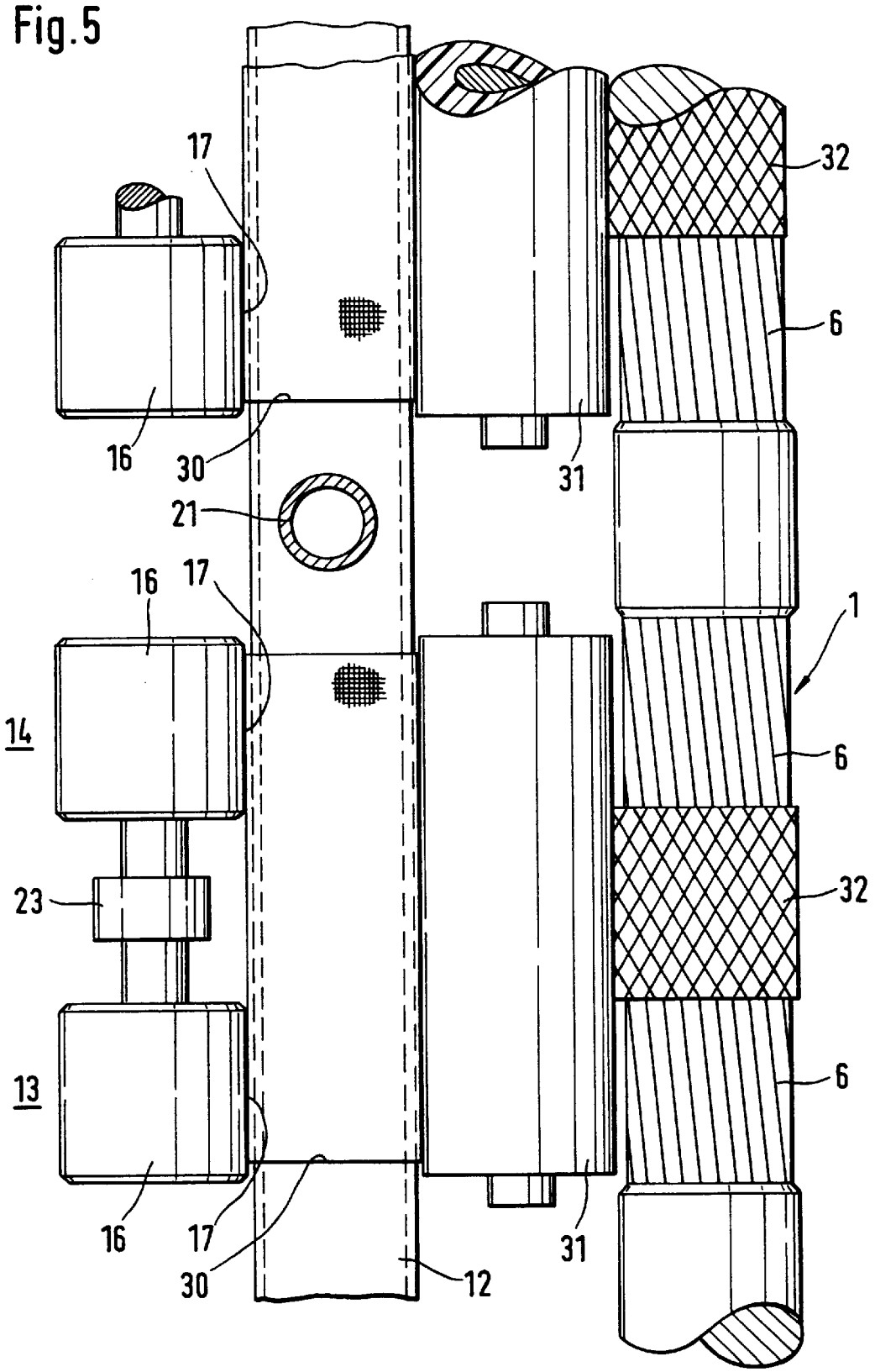
FIG. 5 is a developed view in the direction of the arrow V of FIG. 4.

In the embodiment according to FIGS. 4 and 5, the drive for the sieve belt 30 and the nipping roller 16 is not derived from the front top roller 7, but from the front bottom roller 6. The sieve belt 30 is in this case a somewhat wider closed tube belt, which extends over two spinning stations 13 and 14. The nipping rollers 16 of these spinning stations 13 and 14 take here the advantageous form of a top roller twin.

Between the driven bottom cylinder which supports the front bottom roller 6, and the sieve belt 30, which is guided around the hollow profile 12, there is an intermediary roller 31, which also extends over the two spinning stations 13,14. The front top roller 7, the nipping roller 16, as well as the intermediary roller 31, are each provided with a flexible coating, which permits the necessary friction drive. The intermediary roller 31 is disposed on a diagonally knurled area 32 of the bottom cylinder, whereby this area 32 is enlarged in diameter compared to the front bottom roller 6 to such a degree that the peripheral speed of the sieve belt 30 is greater by the amount of the desired draft than the peripheral speed of the front roller pair 2. The sieve belt 30 is thus driven by the diagonally knurled area 32 and in turn drives the nipping roller 16.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for a spinning machine comprising:

a front roller pair ending a main drafting zone of a drafting assembly, and a condensing zone downstream of the front roller pair, which condensing zone bundles a drafted fiber strand and which condensing zone is ended by a driven nipping roller which presses the fiber strand against a supporting surface wherein the peripheral speed of the nipping roller is between 3% and 8% greater than the peripheral speed of the front roller pair to thereby draft the fiber strand in the condensing zone by a factor of between 3% and 8%.

2. An arrangement according to claim 1, wherein the nipping roller is drivingly connected to a roller of the front roller pair.

3. An arrangement according to claim 2, wherein a sieve belt is arranged at the nipping roller, which sieve belt transports the fiber strand with the peripheral speed of the nipping roller over a suction slit in said condensing zone.

4. An arrangement according to claim 3, wherein the sieve belt is driven by the nipping roller.

5. An arrangement according to claim 2, wherein said condensing zone includes a sieve belt which in use transports the fiber strand over a suction slit.

6. An arrangement according to claim 1, wherein a sieve belt is arranged at the nipping roller, which sieve belt transports the fiber strand with the peripheral speed of the nipping roller over a suction slit in said condensing zone.

7. An arrangement according to claim 6, wherein the sieve belt is driven by the nipping roller.

8. An arrangement according to claim 7, wherein the sieve belt is guided in an area of the nipping roller over a stationary sliding surface, which stationary sliding surface comprises the suction slit.

9. An arrangement according to claim 8, wherein the sieve belt, on its side facing the sliding surface, is smoother than on its side facing away from the sliding surface.

10. An arrangement according to claim 6, wherein the nipping roller is driven by means of the sieve belt.

11. An arrangement according to claim 10, wherein the sieve belt is guided in an area of the nipping roller over a stationary sliding surface, which stationary sliding surface comprises the suction slit.

12. An arrangement according to claim 11, wherein the sieve belt, on its side facing the sliding surface, is smoother than on its side facing away from the sliding surface.

13. An arrangement according to claim 6, wherein the sieve belt is guided in an area of the nipping roller over a stationary sliding surface, which stationary sliding surface comprises the suction slit.

14. An arrangement according to claim 13, wherein the sieve belt, on its side facing the sliding surface, is smoother than on its side facing away from the sliding surface.

15. An arrangement according to claim 14, wherein the sliding surface is curved in transport direction of the fiber strand.

16. An arrangement according to claim 13, wherein the sliding surface is curved in transport direction of the fiber strand.

17. An arrangement according to claim 6, wherein the drafting assembly comprises a top weighting arm in which the nipping roller is arranged.

18. An arrangement according to claim 1, wherein the drafting assembly comprises a top weighting arm in which the nipping roller is arranged.

19. An arrangement according to claim 1, wherein said peripheral speed of the nipping roller is greater by 4% to 7% than the peripheral speed of the front roller pair.

20. An arrangement according to claim 19, wherein said peripheral speed of the nipping roller is greater by about 6% than the peripheral speed of the front roller pair.

21. An arrangement according to claim 1, wherein said condensing zone is disposed in use upstream of a ring spinning unit operable to ring spin the fiber strand supplied from the condensing zone.

22. An arrangement according to claim 1, wherein said condensing zone includes pneumatic condensing means for condensing the fiber strand.

23. An arrangement according to claim 1, wherein said condensing zone includes a sieve belt which in use transports the fiber strand over a suction slit.

24. An arrangement according to claim 1, wherein said peripheral speed of the nipping roller is greater by 4% to 7% than the peripheral speed of the front roller pair.

25. An arrangement according to claim 24, wherein said peripheral speed of the nipping roller is greater by about 6% than the peripheral speed of the front roller pair.

26. An arrangement for a ring spinning machine comprising:

a front roller pair ending a main drafting zone of a drafting assembly, and a condensing zone downstream of the front roller pair, which condensing zone bundles a drafted fiber strand and which condensing zone is ended by a driven nipping roller which presses the fiber strand against a supporting surface, wherein the condensing zone includes a sieve belt which in use transports the fiber strand over a sliding surface with a suction slit, and wherein the sieve belt is smoother on its side facing the sliding surface than on its side facing away from the sliding surface.

27. An arrangement according to claim 26, wherein said condensing zone is disposed in use upstream of a ring spinning unit operable to ring spin the fiber strand supplied from the condensing zone.

28. An arrangement according to claim 26, wherein the sliding surface is curved in transport direction of the fiber strand.

* * * * *